US009212408B2

(12) United States Patent
Satoh et al.

(10) Patent No.: US 9,212,408 B2
(45) **Date of Patent: *Dec. 15, 2015**

(54) DECORATIVE PART WITH SUBSTRATE AND MULTI-LAYER HARDENING LAMINATE

(75) Inventors: Junji Satoh, Kawagoe (JP); Yoshitsugu Shibuya, Toda (JP); Maki Hayakawa, Kodaira (JP); Ryota Koike, Musashimurayama (JP)

(73) Assignee: CITIZEN HOLDINGS CO., LTD., Tokyo (JP)

( * ) Notice: Subject to any disclaimer, the term of this patent is extended or adjusted under 35 U.S.C. 154(b) by 772 days.

This patent is subject to a terminal disclaimer.

(21) Appl. No.: 12/679,089

(22) PCT Filed: Sep. 18, 2008

(86) PCT No.: PCT/JP2008/066892

§ 371 (c)(1),
(2), (4) Date: Mar. 19, 2010

(87) PCT Pub. No.: WO2009/038152

PCT Pub. Date: Mar. 26, 2009

(65) Prior Publication Data

US 2010/0227156 A1 Sep. 9, 2010

(30) Foreign Application Priority Data

Sep. 19, 2007 (JP) ..... 2007-242345

(51) Int. Cl.
*B32B 15/04* (2006.01)
*C23C 28/00* (2006.01)
(Continued)

(52) U.S. Cl.
CPC ..... *C22C 5/02* (2013.01); *C23C 28/321* (2013.01); *C23C 28/322* (2013.01); *C23C 28/34* (2013.01);
(Continued)

(58) Field of Classification Search
CPC ..... C22C 5/02
See application file for complete search history.

(56) References Cited

U.S. PATENT DOCUMENTS 4,093,349 A * 6/1978 Mills ..... 359/883
4,591,418 A 5/1986 Snyder
(Continued)

FOREIGN PATENT DOCUMENTS

CN 1089665 A 7/1994
EP 2135972 A1 * 12/2009
(Continued)

OTHER PUBLICATIONS

Chinese Office Action corresponding to Chinese Patent Application No. 200880107878.8, dated Apr. 21, 2011.
(Continued)

*Primary Examiner* — Monique Jackson
(74) *Attorney, Agent, or Firm* — Sughrue Mion, PLLC

(57) ABSTRACT

A decorative part comprising a hardening layer having a pink Au alloy coating film on a surface of the part. The hardening layer is obtainable by laminating a base layer, a primary layer and a finishing layer from the side of a substrate. The base layer comprises a metal layer comprising one metal or two or more metals selected from Hf, Ti and Zr and, superimposed thereon, a compound layer comprising the same metal constituting the metal layer and further comprising nitrogen, carbon or oxygen. The primary layer has a laminating structure such that an Au alloy layer, and a compound layer comprising one metal or two or more metals selected from Hf, Ti and Zr and further comprising nitrogen, carbon or oxygen are laminated one after the other. The finishing layer comprises an Au alloy layer.

11 Claims, 3 Drawing Sheets

(51) Int. Cl.
*C22C 5/02* (2006.01)
*A44C 27/00* (2006.01)

(52) U.S. Cl.
CPC ..... *C23C 28/341* (2013.01); *C23C 28/3455* (2013.01); *C23C 28/42* (2013.01); *A44C 27/006* (2013.01); *Y10T 156/1002* (2015.01); *Y10T 428/26* (2015.01); *Y10T 428/31678* (2015.04)

(56) References Cited

U.S. PATENT DOCUMENTS

| | | | | | |
|---|---|---|---|---|---|
| 4,737,252 | A | | 4/1988 | Hoffman | |
| 4,791,017 | A | * | 12/1988 | Hofmann et al. | 428/216 |
| 5,256,275 | A | * | 10/1993 | Brasch | 205/247 |
| 6,063,213 | A | * | 5/2000 | Ogasa | 148/430 |
| 8,178,222 | B2 | * | 5/2012 | Miya et al. | 428/698 |
| 2003/0224201 | A1 | * | 12/2003 | Kawakami et al. | 428/672 |
| 2004/0093730 | A1 | | 5/2004 | Miya et al. | |

FOREIGN PATENT DOCUMENTS

| | | | | |
|---|---|---|---|---|
| GB | 2091294 | A | * | 7/1982 |
| GB | 2138027 | A | * | 10/1984 |
| GB | 2284431 | A | | 6/1995 |
| JP | 54-028238 | A | | 3/1979 |
| JP | 54-085126 | A | | 7/1979 |
| JP | 57-120644 | A | | 7/1982 |
| JP | 59-190340 | A | | 10/1984 |
| JP | 60218439 | A | * | 11/1985 |
| JP | 61-104069 | A | | 5/1986 |
| JP | 61-127863 | A | | 6/1986 |
| JP | 63-053267 | A | | 3/1988 |
| JP | 03-120355 | A | | 5/1991 |
| JP | 07-018469 | A | | 1/1995 |
| JP | 2006070336 | A | | 3/2006 |
| JP | 2007-162141 | A | | 6/2007 |
| WO | 9747778 | A1 | | 12/1997 |
| WO | WO 2008108181 | A1 | * | 9/2008 |

OTHER PUBLICATIONS

Japanese Office Action corresponding to Japanese Patent Application No. 2009-533187, dated Sep. 21, 2012.

Communication dated Sep. 17, 2014 from the European Patent Office in counterpart application No. 08831870.4.

* cited by examiner

DECORATIVE PART WITH SUBSTRATE AND MULTI-LAYER HARDENING LAMINATE

TECHNICAL FIELD

The present invention relates to a decorative part consisting of a substrate and a hardening layer provided on the substrate, more specifically to a decorative part having a pink Au alloy hardening coating film provided on the outermost surface of the hardening layer.

TECHNICAL BACKGROUND

Stainless steels, Ti and Ti alloys which are soft substrates capable of being worked easily have been widely used for watchcases, watchbands, necklaces, earrings, pierced earrings, rings, eyeglass frames, pendants, brooches, bracelets and other decorative parts. However, it is indicated that decorative parts obtainable by working these soft substrates have an important problem of deterioration in appearance quality caused by occurrence of flaws during the use thereof. This deterioration is mainly caused by a low surface hardness in soft substrates, namely a low Vickers hardness Hv of about 200. In order to solve the deterioration in appearance quality, various kinds of surface hardening treatments have been attempted.

Furthermore, the decorative parts need to have high decorative properties, and sophisticated pink color is preferred as decorative parts. Surface hardening treatment techniques for securing pink color have been attempted.

As a pink decorative part, an exterior part obtainable by forming a pink alloy coating film containing palladium (Pd) in a weight ratio of 1 to 25% on a pink titanium carbonitride coating film is disclosed (Patent document 1). This prior art discloses that about 1 μm of a pink carbonitride is formed by an ion plating method and thereafter about 0.1 μm of an Au alloy containing 10% of Pd is formed. Furthermore, about 1 μm of a pink Ti carbonitride is formed by an ion plating method and thereafter 0.05 μm of a copper coating film is formed and then 0.1 μm of an Au—Pd alloy is formed by a wet plating method to prepare the decorative part. That is to say, since Ti carbonitride is hard, excellent in flaw resistance and pink, but has low brightness and is dark, a pink Au alloy coating film having high brightness is formed thereon and thereby the flaw resistance is maintained.

Moreover, a method such that 0.5 μm of a Ti nitride film is formed on the surface of a substrate by ion plating, and 0.3 μm of co-deposited film of Ti nitride and Ag or Cu is formed by ion plating and further 0.2 μm of an Au—Pt pink gold film is formed by wet plating is disclosed (Patent document 2). In this method, the pink Au alloy film is formed on the hard co-deposited film of Ti nitride and Ag or Cu and thereby the flaw resistance is maintained.

Patent document 1: JP-A-561 (1986)-127863 (p. 3)
Patent document 2: JP-A-563 (1988)-53267 (p. 4)

DISCLOSURE OF THE INVENTION

Subject for Solving by the Invention

However, as a pink Au alloy coating film generally has a low hardness and is brittle, it has a problem in that the aesthetic appearance thereof as a decorative part is easily spoiled. That is to say, when the pink Au alloy coating film has a large thickness of 0.1 to 0.2 μm, flaws caused in the film are deep so that they are easily detected with the naked eye and thereby the aesthetic appearance of the decorative part is spoiled. On the other hand, when a pink Au alloy coating film has a thickness smaller than 0.1 μm, flaws and peelings of the coating film are thin and are hardly visible, but a dark lower layer which is pink but has low brightness is visible as a difference in color tone and thereby the sophisticated pink aesthetic appearance is spoiled.

Under the circumstances, it is an object of the present invention is to provide a decorative part having a pink Au alloy hard coating film capable of maintaining sophisticated pink aesthetic appearance for longtime use by making the decorative part in such a way that even if flaws are caused in the coating film (outmost layer) of the decorative part having a pink Au alloy hard coating film or the coating film is peeled off, the flaws and peelings are hardly visible with the naked eye.

Means for Solving the Subject

The present inventors have been variously studied in order to solve the above problems, and found that a primary layer is provided between a base layer and a finishing layer (outermost layer), so that pink aesthetic appearance can be maintained for longtime use even if flaws and peelings are caused on the fishing layer of a decorative part, the flaws and peelings are hardly visible with the naked eye.

That is to say, the decorative part of the present invention (the decorative part formed with a hardening layer having a pink Au alloy coating film on the surface) is a decorative part comprising a substrate and a hardening layer on the surface of the substrate. The hardening layer is prepared by laminating the base layer, the primary layer and the finishing layer from the substrate side. The base layer comprises a metal layer comprising one or two or more metals selected from Hf, Ti and Zr, and a compound layer comprising the same metal constituting the metal layer and nitrogen, carbon or oxygen. The primary layer has a laminating structure such that an Au alloy layer and a compound layer comprising one or two or more metals selected from Hf, Ti and Zr and nitrogen, carbon or oxygen are laminated one after the other. The finishing layer comprises an Au alloy layer.

The Au alloy layer of the primary layer or the Au alloy layer of the finishing layer comprises an Au alloy comprising Au and Cu as main components, and one or two or more metals selected from Pd, Pt, Ag and Ni, and is preferably an Au alloy layer containing an ordered lattice.

The compound layer of the primary layer is preferably formed from a compound comprising Hf, Ti or Zr and nitrogen, or a compound comprising Hf, Ti or Zr and nitrogen and carbon.

The metal layer of the base layer is formed from Hf, Ti or Zr, and the compound layer of the base layer is preferably formed from a compound comprising the same metal constituting the metal layer and nitrogen, or a compound comprising the same metal constituting the metal layer and nitrogen and carbon.

The primary layer preferably has a laminating structure that lamination of one laminating structure unit, which is composed of one Au alloy layer and one compound layer, is repeated 1 to 11 times.

The primary layer has a thickness of preferably 0.01 to 0.12 μm.

The substrate is preferably at least one metal selected from stainless steel, Ti, a Ti alloy, Au, an Au alloy, Pt, a Pt alloy, Cu and a Cu alloy.

Furthermore, the substrate is also preferably ceramics.

The process for producing the decorative part according to the present invention is a process for producing the decorative part, which comprises the substrate and the hardening layer prepared by laminating the base layer, the primary layer and the finishing layer from the substrate side. The process for producing the decorative part comprises a base layer laminating step of laminating, on the substrate, the base layer formed from the metal layer comprising one or two or more metals selected from Hf, Ti and Zr, and the compound layer comprising the same metal constituting the metal layer and nitrogen, carbon or oxygen; a primary layer laminating step of forming, on the base layer, the primary layer having a laminating structure such that the Au alloy layer and the compound layer comprising one or two or more metals selected from Hf, Ti and Zr, and nitrogen, carbon or oxygen are laminated one after the other; and a finishing layer laminating step of forming the finishing layer comprising the Au alloy layer on the primary layer.

The Au alloy layer of the primary layer or the Au alloy layer of the finishing layer preferably comprises an Au alloy comprising Au and Cu as main components and one or two or more metals selected from Pd, Pt, Ag and Ni. After the finishing layer laminating step, the process, further, preferably comprises an ordered lattice generating step that the substrate formed with the hardening layer is heated in an inert atmosphere or under reduced pressure at a temperature of 300 to 400° C. for 1 to 3 hr, and thereby the Au alloy layer of the primary layer or the Au alloy layer of the finishing layer is made into an Au alloy layer containing an ordered lattice.

The compound layer of the primary layer is preferably formed from a compound comprising Hf, Ti or Zr and nitrogen, or a compound comprising Hf, Ti or Zr and nitrogen and carbon.

The metal layer of the base layer is preferably formed from Hf, Ti or Zr, and the compound layer of the base layer is preferably formed from a compound comprising the same metal constituting the metal layer and nitrogen, or a compound comprising the same metal constituting the metal layer and nitrogen and carbon.

The primary layer preferably has a laminating structure such that lamination of one laminating structure unit, which is composed of one Au alloy layer and one compound layer, is repeated 1 to 11 times.

The primary layer preferably has a thickness of 0.01 to 0.12 μm.

The substrate preferably comprises at least one metal selected from stainless steel, Ti, a Ti alloy, Au, an Au alloy, Pt, a Pt alloy, Cu and a Cu alloy.

The above substrate is also preferably ceramics.

The base layer, the primary layer and the finishing layer are preferably formed by a dry plating method selected from a sputtering method, an ion plating method and an arc ion plating method.

Effect of the Invention

The pink decorative part of the present invention comprises the substrate and hardening layer coating film. The hardening layer coating film comprises the finishing layer of an Au alloy; the primary layer having a laminating structure such that the primary compound layer comprising one or two or more metals selected from Hf, Ti and Zr, and nitrogen, carbon or oxygen and the primary Au alloy layer are laminated one after the other; and the base layer comprising the metal layer comprising one or two or more metals selected from Hf, Ti and Zr and the compound layer comprising the same metal constituting the metal layer and nitrogen, carbon or oxygen.

Herein, a decorative part without the primary layer used in the present invention is described. The base layer is a hard layer having a hardness of not less than 1800 Hv, and the finishing layer is a relatively soft layer having a hardness of not more than 300 Hv. Furthermore, even if the color tone of the base layer is fitted to the pink color tone of the finishing layer as much as possible, the base layer has lower brightness (L* in L*a*b* color specification system) as compared with the finishing layer, and the color of the base layer is confirmed visually to be different color. Therefore, when flaws and peelings are caused in the finishing layer, the base layer is visible and thereby the sophisticated pink aesthetic appearance of the finishing layer cannot be maintained.

Next, the decorative part having the primary layer according to the present invention (the primary layer is set between the finishing layer and the base layer) is described. The primary layer has a hardness of not less than 1600 Hv, and flaws and peelings stop by the primary layer and do not reach the base layer. Furthermore, since the color tone of the primary layer is near to the pink color tone of the finishing layer, even if flaws and peelings are caused in the finishing layer, the flaws and peelings are hardly visible and the sophisticated pink aesthetic appearance can be maintained for long-term use.

In the case that an ordered lattice is deposited on the Au alloy of the finishing layer or the primary layer, the hardness of the finishing layer or the primary layer is increased by deposition hardening and thereby flaws and peelings become smaller (flaws and peelings are hardly caused) and thereby the flaw resistance is more improved.

DESCRIPTION OF MARK

Figure 1:
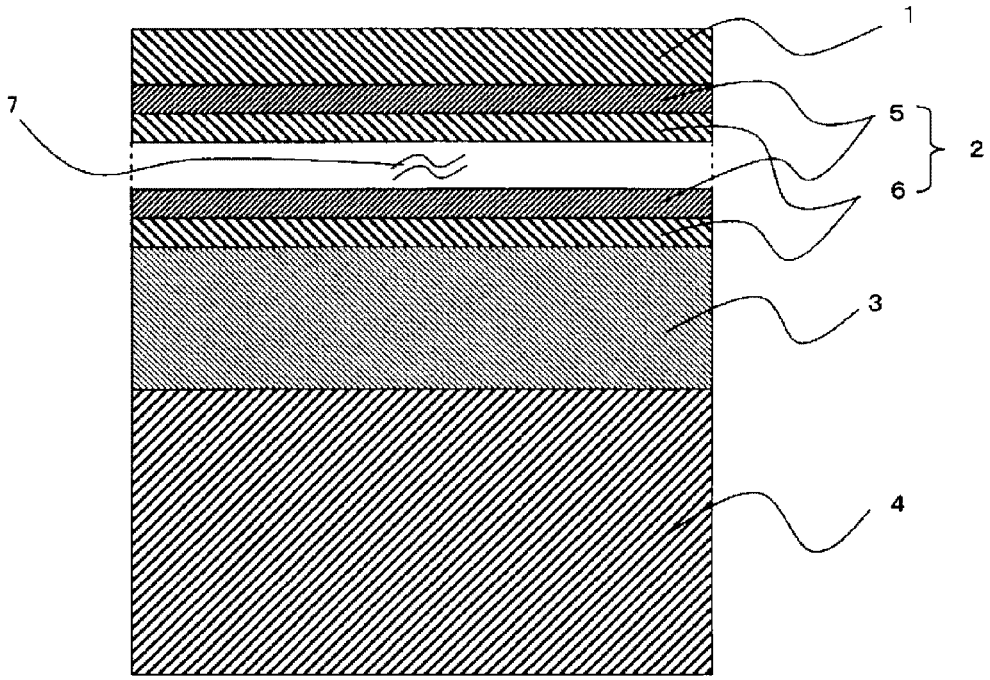
FIG. 1 shows a cross-sectional schematic view showing a hardening layer of a decorative part in one embodiment according to the present invention.

1 Finishing layer
2 Primary layer
3 Base layer
4 Substrate
5 Compound layer
6 Au alloy layer
7 Laminated part

BEST MODE FOR CARRYING OUT THE INVENTION

Hereinafter, embodiments for the pink decorative part according to the present invention will be described in detail.

The cross sectional schematic view of the hardening layer of the decorative part in one embodiment according to the present invention is shown in FIG. 1. As shown in FIG. 1, the decorative part of the present invention comprises a substrate 4 and a pink hardening layer coating film, and the hardening layer coating film comprises a base layer 3, a primary layer 2 and a finishing layer 1. The hardening layer coating film is formed usually by a sputtering method, an ion plating method or an arc method.

For the substrate 4, at least one metal selected from stainless steel, Ti, a Ti alloy, Au, an Au alloy, Pt, a Pt alloy, Cu and a Cu alloy or ceramics is used.

The base layer 3 comprises a metal layer comprising one, or two or more metals selected from Hf, Ti and Zr, and, superimposed thereon, a compound layer comprising the same metal constituting the metal layer and nitrogen, carbon or oxygen. The base layer 3 has a thickness of preferably not less than 1.0 μm. In the base layer 3, the amounts of nitrogen, carbon and oxygen are usually regulated in order that the color tone of the base layer 3 is nearer to the color tone of the finishing layer 1. However, since a pink carbon nitrogen oxide comprising Hf, Ti or Zr has lower lightness as compared with the brightness of a pink Au alloy, the color of the pink carbonitroxide was visually recognized as a clearly different color.

The color tone of the base layer 3 of the present invention is indicated by L*a*b* color specification system, and the typical values are L*: 64.2, a*: 13.2 and b*: 22.1. The typical values of the color tone of the coating film comprising only an Au alloy which is the finishing layer 1 (pink color tone having sophisticated appearance) in L*a*b* color specification system are L*: 84.3, a*: 13.0 and b*: 21.5. The color difference of the base layer 3 to the coating film comprising only an Au alloy which is the finishing layer 1 is large, i.e. ΔE*a*b* is 20.1. This color difference is caused by the difference in brightness L*.

The typical values of the color tone of the primary layer 2 (containing the base layer 3) according to the present invention are L*: 74.0, a*: 13.1 and b*: 21.9. The color difference ΔE*a*b* of the primary layer 2 containing the base layer 3 to the coating film comprising only an Au alloy which is the finishing layer 1 is 10.4. The color difference is lower than the color difference in the base layer 3, and the color tone of the primary layer 2 is nearer to the color tone of the finishing layer 1.

The typical values of the color tone of the decorative part prepared by the present invention are L*: 82.1, a*: 13.1 and b*: 21.3. The color difference ΔE*a*b* of the finishing layer 1 containing the base layer 3 and the primary layer 2 to the coating film comprising only an Au alloy which is the finishing layer 1 is 2.2. This color difference shows the color tone of the decorative part of the present invention. It is preferred that ΔE*a*b*<3.0. The color tone shows the color tone of the pink Au alloy having high-grade appearance.

The repetition number n of lamination of the Au alloy layer 6 and the compound layer 5 in the primary layer 2 can be changed in accordance with the film thicknesses of the Au alloy layer 6 and the compound layer 5. The thickness of the primary layer 2 is preferably within 0.12 μm. The laminated part 7 in FIG. 1 is a part where the Au alloy layer 6 and the compound layer 5 are laminated one after the other.

Figure 2:
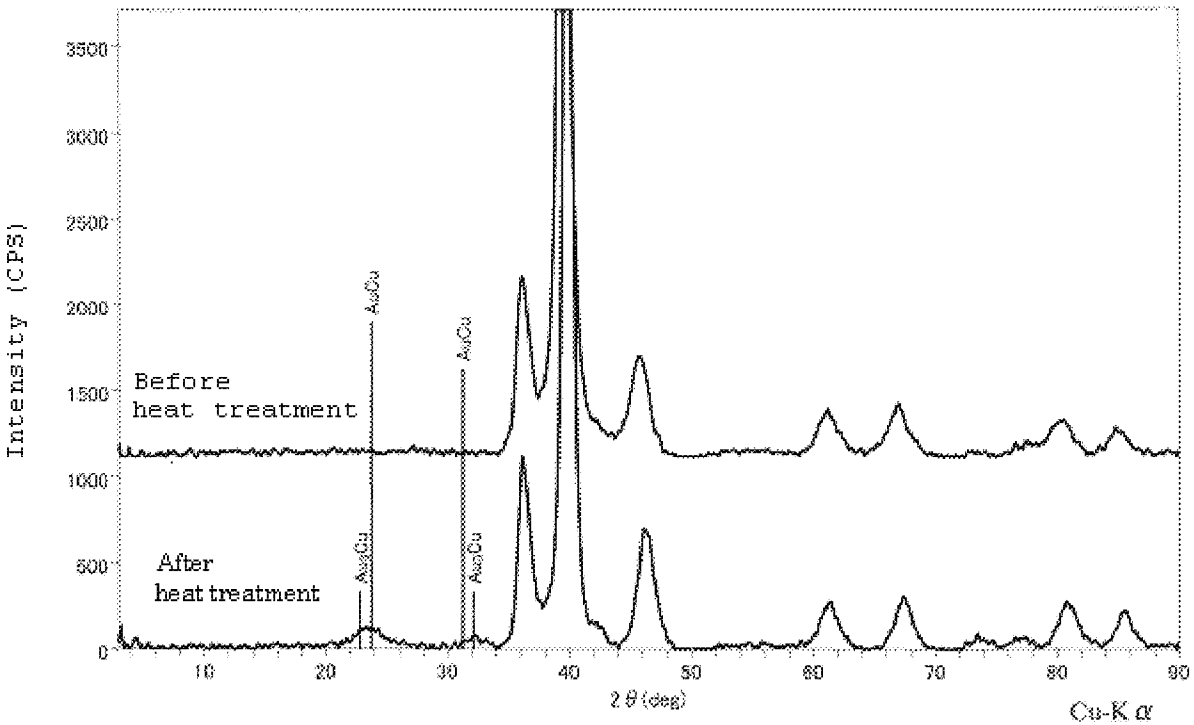
FIG. 2 shows a view showing a XRD pattern of the surface of a decorative part in one embodiment according to the present invention.

The Au alloy layer of the finishing layer 1 is an Au alloy, which comprises Au and Cu as main components and further comprises one or two or more metals selected from Pd, Pt, Ag and Ni. Furthermore, the Au alloy layer preferably contains an ordered lattice detected by XRD as shown in FIG. 2.

Regarding the hardness of the finishing layer 1 (containing the base layer 3 and the primary layer 2) according to the present invention, the surface hardness, as determined under a load of 5 mN for a retention time of 10 sec using a hardness meter Fisher scope H100, is usually 1500 to 2000 Hv, preferably 1700 to 2000 Hv.

The embodiments of the decorative part according to the present invention are described in more detail below.

Embodiment 1

The decorative part of the embodiment 1 is a decorative part which comprises a substrate 4 and, superimposed on the substrate 4, a hardening layer, and the hardening layer is obtainable by laminating a base layer 3, a primary layer 2 and a finishing layer 1 from the side of the substrate 4 (referred to FIG. 1).

<Substrate>

As the substrate 4, at least one metal selected from stainless steel, Ti, a Ti alloy, Au, an Au alloy, Pt, a Pt alloy, Cu and a Cu alloy, ceramics or plastics is used. Furthermore, it is preferred to use stainless steel, Ti, a Ti alloy, Au, an Au alloy, Pt, a Pt alloy, Cu, a Cu alloy or ceramics.

Examples of the stainless steel may include Fe—Cr alloys (specifically SUS405, SUS430, SUS434, SUS444, SUS429, SUS430 and the like) and Fe—Cr—Ni alloys (specifically SUS304, SUS303, SUS316, SUS316L, SUS316J1, SUS316J1L and the like). Examples of the ceramics may include oxide ceramics such as $Al_2O_3$, $SiO_2$, $TiO_2$, $Ti_2O_3$, $ZrO_2$, $Y_2O_3$, barium titanate and strontium titanate; nitride ceramics such as AlN, $Si_3N_4$, SiN, TiN, BN, ZrN, HfN, VN, TaN, NbN, CrN and $Cr_2N$; carbide ceramics such as graphite, SiC, ZrC, $Al_4C_3$, $CaC_5$, WC, TiC, HfC, VC, TaC and NbC; boride ceramics such as $ZrB_2$ and MoB; and composite ceramics obtainable by mixing two or more kinds of these ceramics. As the plastics, conventionally known thermoplastic resins and thermosetting resins are used.

The shape of the substrate 4 is not particularly limited as far as the desired decorative part can be prepared.

<Base Layer>

The base layer 3 comprises a metal layer comprising one or two or more metals selected from Hf, Ti and Zr, and a compound layer comprising the same metal constituting the metal layer and nitrogen, carbon or oxygen. The decorative part provided with the base layer 3 is improved in hardness and thereby improved in flaw resistance.

Examples of the compound for forming the compound layer may include nitrides, carbides or carbonitroxides of Hf, Ti or Zr.

Among them, from the standpoint of the color tone, the metal layer is preferably formed from Hf, Ti or Zr, and the compound layer is preferably formed from a compound comprising the same metal constituting the metal layer and nitrogen or a compound comprising the same metal constituting the metal layer, nitrogen and carbon. That is to say, it is more preferred that the metal layer be formed from Hf and the compound layer be formed from Hf nitride or carbonitride (in the present specification, sometimes referred to HfN or HfCN), the metal layer be formed from Ti and the compound layer be formed from Ti nitride or carbonitride (in the present specification, sometimes referred to TiN or TiCN), or the metal layer be formed from Zr and the compound layer be formed from Zr nitride or carbonitride (in the present specification, sometimes referred to ZrN or ZrCN).

When HfN is used, the nitrogen content of the layer formed from HfN is usually 4 to 14% by mass and the residue is Hf (the total amount of Hf and nitrogen is 100% by mass). When HfCN is used, the nitrogen content of the layer formed from HfCN is usually 3 to 14% by mass, the carbon content is usually 3 to 12% by mass and the residue is Hf (the total amount of Hf, carbon and nitrogen is 100% by mass). When TiN is used, the nitrogen content of the layer formed from TiN is usually 13 to 37% by mass and the residue is Ti (the total amount of Ti and nitrogen is 100% by mass). When TiCN is used, the nitrogen content of the layer formed from TiCN is usually 13 to 37% by mass, the carbon content is usually 4 to 34% by mass and the residue is Ti (the total amount of Ti, carbon and nitrogen is 100% by mass). When ZrN is used, the nitrogen content of the layer formed from ZrN is usually 7 to 24% by mass and the residue is Zr (the total amount of Zr and nitrogen is 100% by mass). When ZrCN is used, the nitrogen content of the layer formed from ZrCN is usually 7 to 24% by mass, the carbon content is usually 6 to 21% by mass and the residue is Zr (the total amount of Zr, carbon and nitrogen is 100% by mass). The content is a value obtained with quantitative analysis using XPS (QUANTUM 2000) manufactured by PHYSICL ELECTRONICS CO, LTD.

Of these, since TiCN has pink color tone and excellent hardness, it is particularly preferred that the metal layer be formed from Ti and the compound layer be formed from TiCN.

The base layer 3 has a thickness of usually not less than 1.0 μm, preferably 1.0 to 2.0 μm. The film thickness is determined by the measurement with SEM. In the film thickness of the base layer, the thickness of the metal layer is 5 to 20% and the thickness of the compound layer is usually 80 to 95%.

When the base layer 3 that the metal layer is formed from Ti, the compound layer is formed from TiCN and the film thickness is in the above range is formed on the substrate 4, L* is usually 60 to 70 in the L*a*b* color specification system and pink color tone is obtained. The color difference ΔE*a*b* between the coating film formed from Au—Cu—Pd alloy which is a typical alloy having sophisticated pink color tone and the substrate 4 on which the base layer 3 is formed, is usually 15 to 25. L*a*b* of the Au—Cu—Pd alloy coating film is a value determined in the following way. On a Si wafer substrate (10 mm×10 mm), the Au—Cu—Pd alloy is formed in a thickness of about 1 μm by a sputtering method. Next, the film is subjected to color tone measurement of L*a*b* color specification system as defined in JIS Z 8729 using a color meter (CM2600d) manufactured by Konica Minolta Holdings, Inc. to determine the L*a*b* values.

When the base layer 3 that the metal layer is formed from Ti, the compound layer is formed from TiCN and the base layer 3 having a film thickness in the above range is formed on the substrate 4, the surface hardness as measured under a load of 5 mN for a retention time of 10 sec using a hardness tester (Fisher scope H100) is usually 1800 to 2500 Hv.

<Primary Layer>

The primary layer 2 has a structure such that the Au alloy layer 6 and the compound layer 5 which comprises one or two or more metals selected from Hf, Ti and Zr, and nitrogen, carbon or oxygen are laminated one after the other. Specifically, the Au alloy layer 6 is formed on the side of the base layer 3 and the compound layer 5 is formed on the side of the finishing layer 1 (the outermost layer). Providing the primary layer 2, the decorative part can have high flaw resistance.

Among the above layers, the Au alloy layer 6 preferably comprises an Au alloy comprising Au and Cu as main components and one or two or more metals (other metals) selected from Pd, Pt, Ag and Ni, more preferably Au and Cu as main components and Pd (in the present specification, referred to Au—Cu—Pd alloy). In the above Au alloy, the Au content is preferably 79.5 to 94.5% by mass, the Cu content is preferably 5 to 20% by mass and the total other metal content is preferably 0.5 to 5% by mass provided that the total of Au, Cu and other metals is 100% by mass. The content is a value determined by the quantitative analysis with EPMA (JXA8200) manufactured by JEOL Co. The decorative part prepared by using such an Au alloy has sophisticated pink color tone and has higher flaw resistance.

Examples of the compound forming the compound layer 5 may include nitrides, carbides or carbonitroxide of Hf, Ti or Zr.

The compound layer 5 is preferably formed from a compound comprising Hf, Ti or Zr and nitrogen or a compound comprising Hf, Ti or Zr and nitrogen and carbon from the standpoint of color tone. That is to say, the compound layer 5 is more preferably formed from HfN, HfCN, TiN, TiCN, ZrN or ZrCN. In the case of the use thereof, the nitrogen and carbon contents in the layer are similar to those in the compound layer of the base layer.

Of these, from the standpoint of color tone and flaw resistance, TiCN is favorably used particularly.

The Au alloy layer 6 and the compound layer 5 each have a thickness of preferably 0.005 to 0.03 μm, and the primary layer 2 has a thickness (thickness of all laminating structure) of preferably 0.01 to 0.12 μm. The primary layer 2 has a laminating structure such that lamination of one laminating structure unit, which is composed of one Au alloy layer and one compound layer, is repeated 1 to 11 times (laminating structure having a repetition number n of 1 to 11), preferably a laminating structure such that the lamination of the one unit is repeated 4 to 6 times (laminating structure having a repetition number n of 4 to 6). When n is 4 to 6, flaws are difficult to enter the base layer in a flaw resistance test and the flaw resistance is more excellent. Furthermore, the disharmony in color tone of flaw traces after testing is decreased. When each thicknesses of the Au alloy layer 6 and the compound layer 5 is less than 0.005 μm, both of the layers do not form a laminating structure and thereby are occasionally formed into a mixing layer. Moreover, when each thicknesses of the Au alloy layer 6 and the compound layer 5 are about 0.01 μm, the effect of lamination is more excellent.

From the standpoint of the color tone, hardness and flaw resistance of the resulting decorative part, in the embodiment 1, it is particularly preferred that the Au alloy layer 6 comprise Au—Cu—Pd alloy, the compound layer 5 comprise TiCN and the thicknesses of the Au alloy layer 6, the compound layer 5 and the primary layer 2, and n are in the above range. (In the present specification, the primary layer in the preferred embodiment is sometimes referred to a primary layer A).

When this primary layer A is formed on the substrate 4 and the base layer 3, L* in the L*a*b* color specification system becomes larger than one before the primary layer A is formed, L* is usually 70 to 78 and pink color tone is obtained. Furthermore, in this case, the color difference ΔE*a*b* as compared to the Au—Cu—Pd alloy coating film becomes smaller than one before the primary layer A is formed, and ΔE*a*b* is usually 5 to 15.

Moreover, when this primary layer A is formed on the substrate 4 and the base layer 3, the surface hardness is usually 160 to 2200 Hy.

As is clear from the comparison in L* and ΔE*a*b* values, the color tone of the primary layer A in the preferred embodiment is nearer to the color tone of the finishing layer 1 as compared with the base layer 3, and is sophisticated pink. When the finishing layer 1 having a thickness of not more than 0.1 mm as described later is formed on the primary layer A, it is visually confirmed that the color tones of the primary layer A and the finishing layer 1 are mixed. However, since the primary layer A has excellent color tone as described above, the mixed color tone visually confirmed is sophisticated pink. Even if the finishing layer 1 is flawed, flaws stop in the primary layer A and hardly reach the base layer 3 because the primary layer A has excellent hardness and flaw resistance. Furthermore, even if the finishing layer 1 is flawed and the primary layer A is exposed, flaws hardly stand out and thereby the aesthetic appearance of the decorative part is maintained because the primary layer A has excellent color tone as described above.

<Finishing Layer>

The finishing layer 1 comprises an Au alloy layer. Providing the finishing layer 1, the decorative part having sophisticated pink color tone can be prepared.

The finishing layer 1 preferably comprises an Au alloy comprising Au and Cu as main components and one or two or more metals (other metals) selected from Pd, Pt, Ag and Ni, more preferably an Au—Cu—Pd alloy. In the Au alloy, the Au content is preferably 79.5 to 94.5% by mass, the Cu content is preferably 5 to 20% by mass and the total other metal content is preferably 0.5 to 5% by mass. The finishing layer having sophisticated pink color tone can be prepared by such an Au alloy.

The finishing layer 1 has a thickness of usually 0.005 to 0.1 μm, preferably 0.01 to 0.1 μm. When the thickness is less than the above range, the color tone of the primary layer 2 appears strongly and thereby sometimes the sophisticated pink color tone is not prepared. When the thickness is larger than the above range, flaws caused in the finishing layer deep and thereby are easily confirmed visually. When the finishing layer 1 has a thickness of less than 0.1 μm, flaws do not stand out so much.

The finishing layer 1 has a surface roughness Ra of usually 1.0 to 10.0 mm. When the surface roughness is in the above range, the finishing layer 1 has excellent brightness. The surface roughness Ra shows an arithmetical average roughness as defined in JIS B0601-1994 and is a value measured using a stylus type surface roughness tester (Alpha-Step IQ) manufactured by KLA-Tencor Co.

The decorative part prepared by forming the finishing layer 1 having a thickness of 0.01 to 0.1 μm formed from the Au—Cu—Pd alloy (in the present specification, such a finishing layer in the preferred embodiment is sometimes referred to the finishing layer A) on the substrate 4, the base layer 3 and the primary layer A, has L* in the L*a*b* color specification system larger than that before forming the finishing layer A, L* is usually 80 to 86 and sophisticated pink color tone can be obtained. In this case, the color difference ΔE*a*b* as compared to the Au—Cu—Pd alloy coating film is smaller than that before forming the finishing layer A, and is usually 0 to 3.

The decorative part prepared by forming the finishing layer A on the substrate 4, the base layer 3 and the primary layer A has a surface hardness of usually 1500 to 2000 Hv.

In the decorative part prepared by the combination of the finishing layer A and the primary layer A in the preferred embodiment, the color tones of the primary layer A and the finishing layer A are mixed and thereby sophisticated pink color is confirmed visually and also excellent flaw resistance is obtained.

<Decorative Part>

The decorative parts of the present invention have the above-described hardening layer and are used for watch cases, watch bands, necklaces, earrings, pierced earrings, rings, eyeglass frames, pendants, brooches and bracelets.

<Production Process>

The process for producing the decorative part according to the embodiment 1 is a process for producing the decorative part, which comprises the substrate and the hardening layer prepared by laminating the base layer, the primary layer and the finishing layer from the substrate side. The process comprises abase layer laminating step of laminating, on the substrate, the base layer formed from the metal layer comprising one or two or more metals selected from Hf, Ti and Zr, and the compound layer comprising the same metal constituting the metal layer and nitrogen, carbon or oxygen; a primary layer laminating step of forming, on the base layer, the primary layer having a laminating structure such that the Au alloy layer and the compound layer comprising one or two or more metals selected from Hf, Ti and Zr, and nitrogen, carbon or oxygen are laminated one after the other; and a finishing layer laminating step of forming the finishing layer comprising the Au alloy layer on the primary layer.

In the base layer laminating step, the primary layer laminating step and the finishing layer laminating step, the base layer, the primary layer and the finishing layer are formed by a dry plating method such as a sputtering method, an ion plating method, an arc method and an ion plating method.

More specifically, when the metal layer is formed in the base layer laminating step, the metal layer having a desired metal content can be prepared by appropriately controlling the rate of vaporizing a metal such as Ti, Zr or Hf, the rate of sputtering and electric power for supply to gaseous plasma. Furthermore, the film thickness can be regulated by appropriately changing the rate of vaporizing a metal such as Ti, Zr or Hf, the rate of sputtering and electric power for supply to gaseous plasma. In forming the compound layer, the compound layer having a desired content can be prepared by appropriately controlling the rate of vaporizing a metal such as Ti, Zr or Hf, the rate of sputtering, the flow rate of a reactive gas such as $N_2$, $CH_4$, etc. and electric power for supply to gaseous plasma. Furthermore, the film thickness can be regulated by appropriately changing the rate of vaporizing a metal such as Ti, Zr or Hf, the rate of sputtering and electric power for supply to gaseous plasma.

When the Au alloy layer is formed in the primary layer laminating step, the layer having a desired content can be prepared by appropriately controlling the Au alloy composition of the sputtering target and electric power for supply to gaseous plasma. Furthermore, the film thickness can be regulated by appropriately changing the rate of vaporizing an Au alloy, the rate of sputtering and electric power for supply to gaseous plasma. In the forming the compound layer, the layer having a desired content can be prepared by appropriately controlling the rate of vaporizing a metal such as Ti, Zr or Hf, the rate of sputtering, the flow rate of a reactive gas such as $N_2$, $CH_4$, etc. and electric power for supply to gaseous plasma. Furthermore, the film thickness can be regulated by appropriately changing the rate of vaporizing a metal such as Ti, Zr or Hf, the rate of sputtering and electric power for supply to gaseous plasma.

In the finishing layer laminating step, the layer having a desired content can be prepared by appropriately controlling the Au alloy composition of the sputtering target and electric power for supply to gaseous plasma. Furthermore, the film thickness can be regulated by appropriately changing the rate of vaporizing an Au alloy or the rate of sputtering and electric power for supply to gaseous plasma.

Embodiment 2

The decorative part according to the embodiment 2 is fundamentally as same as one in the embodiment 1 and further has the following properties.

In the embodiment 2, as similar to the above, the Au alloy layer of the primary layer 2 or the Au alloy layer of the finishing layer 1 comprises an Au alloy which comprises Au and Cu as main components and one or two or more metals selected from Pd, Pt, Ag and Ni, and further the Au alloy layer of the primary layer 2 or the Au alloy layer of the finishing layer 1 contains an ordered lattice (referred to FIG. 1).

The description that the Au alloy layer of the primary layer 2 or the Au alloy layer of the finishing layer 1 contains an ordered lattice means the fact that in the XRD pattern measurement of the decorative part according to the embodiment 2, that peaks derived from AuCu appear at 2θ=(23.9)° and 2θ=(31.9)° and peaks derived from $Au_3Cu$ appear at 2θ=(22.3)° and 2θ=(31.7)°. The XRD pattern measurement is carried out with X-ray diffraction apparatus (Smartlab) manufactured JEOL Co., using Cu—Ka ray by a thin film diffraction method. When the diffraction lines overlap, the diffraction angle is determined by carrying out wave-form separation.

In the embodiment 2, as similar to the above, the thicknesses of the Au alloy layer 6 and the compound layer 5 each are usually 0.005 to 0.03 μm. The thickness of the primary layer 2 (the thickness of all the laminating structure) may be 0.01 to 0.24 μm. Furthermore, the primary layer 2 may have a structure such that lamination of one laminating structure unit, which is composed of one Au alloy layer and one compound layer, is repeated 1 to 13 times (laminating structure wherein n=1 to 13). Even if the thickness of the primary layer 2 and n are larger than those in the preferred embodiment 1, the Au alloy layer contains an ordered lattice and thereby a decorative part having excellent color tone and flaw resistance can be prepared.

The surface roughness Ra of the finishing layer 1 is usually 1.0 to 10.0 nm. It is considered that since the Au alloy layer of the finishing layer 1 contains an ordered lattice, the surface roughness becomes small.

When the Au alloy layer of the primary layer 2 or the Au alloy layer of the finishing layer 1 contains an ordered lattice, the surface roughness of the finishing layer 1 becomes small and the brightness is heightened and thereby a decorative part having more sophisticated pink color tone can be prepared. Moreover, since the hardness of the Au alloy layer is higher, the flaw resistance of the decorative part is more excellent.

The process for producing the decorative part according to the embodiment 2 is fundamentally as same as that in the embodiment 1, and further has the following properties.

After the finishing layer laminating step, the process of the embodiment 2 further comprises an ordered lattice generating step that the substrate formed with the hardening layer is heated in an inert atmosphere or under reduced pressure at a temperature of 300 to 400° C., preferably 330 to 370° C., for 1 to 3 hr, preferably 1.5 to 2.0 hr and thereby the Au alloy layer of the primary layer or the Au alloy layer of the finishing layer is made into an Au alloy layer containing an ordered lattice.

The inert atmosphere may include Ar gas, $N_2$ gas or He gas atmosphere. The reduced pressure is preferably $10^{-3}$ to $10^{-5}$ Pa.

The decorative part according to the embodiment 1 (in which the Au alloy layer of the primary layer 2 or the Au alloy layer of the finishing layer 1 comprises an Au alloy comprising Au and Cu as main components and one or two or more metals selected from Pd, Pt, Ag and Ni) is still subjected to the above ordered lattice generating step and thereby the decorative part according to the embodiment 2 is prepared. In this case, the brightness L* is usually increased by 0.5 to 1.0, ΔE*a*b* is usually decreased by 0.08 to 1.27, the surface hardness is usually increased by 20 to 50 HV and Ra is usually decreased by 0.2 to 5 nm. As described above, a decorative part having more sophisticated pink color tone can be prepared. Furthermore, since the hardness of the Au alloy layer is much higher, the flaw resistance of the decorative part is more excellent.

EXAMPLE

The present invention will be described with reference to the following examples below, but it should not be limited by these examples. The substrates used for the decorative parts prepared in the following examples were prepared by mechanically processing stainless steel SUS316L materials to prepare watchcases, mirror polishing the surfaces of the watchcases, and degreasing and cleaning with an organic solvent and the like.

<Example concerning Embodiment 1>

In each example, a stainless steel SUS316L material was mechanically processed to prepare a watchcase, the surface thereof was mirror polished, and degreased and cleaned with an organic solvent etc. to prepare a substrate. On the substrate, the above-mentioned base layer, primary layer and finishing layer were continuously formed by a sputtering method and thereby a sophisticated decorative part having pink Au alloy color tone and excellent flaw resistance was prepared.

Examples 1-11

The examples of the present invention will be described with reference to a drawing. FIG. 1 is a cross sectional schematic view showing a hardening layer of a decorative part, which is one embodiment of the decorative part of the present invention. In each example, a stainless steel 316L material was mechanically processed to prepare a watchcase, and the surface thereof was mirror polished, and degreased and cleaned with an organic solvent etc. to prepare a substrate 4. On the substrate 4, a base layer 3, a primary layer 2 and a finishing layer 1 were formed by a DC sputtering method. Concerning the base layer 3, at first 0.2 μm of a Ti metal layer was formed in Ar plasma and then 0.8 μm of a Ti carbonitride layer was formed in Ar, nitrogen and methane mixed plasma. In this way, the base layer 3 having a thickness of 1.0 μm was formed. Subsequently, 0.005 μm of a Au—Cu—Pd alloy film in Ar plasma from an alloy target having an Au-8Cu-1Pd composition (wherein the value of 8Cu or 1Pd shows the content (% by mass) of Cu or Pd contained in an Au alloy based on 100% by mass of the whole Au alloy) and 0.005 μm of a Ti carbonitride layer in Ar, nitrogen and methane mixed plasma were formed one after the other repeatedly to form the primary layer 2. The repetition number n was 1 to 11 times. Subsequently, on each of these specimens, an Au—Cu—Pd alloy film was formed from an alloy target having a Au-8Cu-1Pd composition in Ar plasma to form the finishing layer 1 having a thickness of 0.02 μm and thereby a decorative part was prepared.

Regarding each of the metal layer and the Ti carbonitride layer in the base layer 3, the Au—Cu—Pd layer and the Ti carbonitride layer in the primary layer 2 and the finishing layer 1, the cross section of the film was prepared by FIB (FB-2000A manufactured by Hitachi, Ltd.) after the formation of each layer and the film thickness was measured by SEM (S-4100 Hitachi, Ltd).

On the assumption that the primary layer 2 has the same Au—Cu—Pd alloy film composition as that of the finishing layer 1, the quantitative analysis thereof was carried out by EPMA (JXA8200) manufactured by JOEL, Ltd. utilizing a ZAF method. As a result, the composition of the Au—Cu—Pd alloy film was Au-(8.5±0.2)Cu-(1.0±0.1)Pd (% by mass).

In each of Examples 2 to 54, the film thickness and the Au—Cu—Pd alloy film composition were determined in the same manner as in Example 1.

Comparative Example 1

In Comparative Example 1, a base layer 3 and a finishing layer 1 were formed without formation of a primary layer 2. The base layer 3 was formed by first forming 0.2 μm of a Ti metal layer in Ar plasma and then forming 0.8 μm of a Ti carbonitride layer in Ar, nitrogen and methane mixed plasma.

In the above way, the base layer having a thickness of 1.0 μm was formed. Subsequently, an Au—Cu—Pd alloy film was formed from an alloy target having an Au-8Cu-1Pd composition in Ar plasma to form the finishing layer having a thickness of 0.02 μm. Thus, a decorative part was prepared.

The decorative parts prepared in Examples 1 to 11 and Comparative Example 1, were evaluated on (1) brightness, (2) color difference, (3) hardness, (4) flaw resistance, (5) corrosion resistance, (6) adhesion and (7) overall evaluation. The methods for the evaluations are shown below.

(1) Brightness

The brightness L* of the surface of a resulting decorative part was measured by a color meter (CM2600d) manufactured by Konica Minolta Holdings, Inc. As the sophisticated pink gold alloy color has a high brightness property, L*≤80 was decided to be acceptable (○), while L*<80 was decided to be unacceptable (X).

(2) Color Difference

The color difference ΔE*a*b* between the surface of a resulting decorative part and an alloy film having typical pink color tone and an Au-8Cu-1Pd composition was measured by a color meter (CM2600d) manufactured by Konica Minolta Holdings, Inc. As for color difference, when ΔE*a*b*>3, the color tone is dark, ΔE*a*b*≤3 was decided to be acceptable, while ΔE*a*b*>3 was decided to be unacceptable.

(3) Hardness

The surface hardness of a resulting decorative part was measured using a hardness meter (Fisher scope (R) H100 manufactured by Fisher Instruments, Ltd.) with maintaining under a load of 5 mN for 10 sec. The hardness of not less than 1500 Hv was decided to be acceptable.

(4) Flaw Resistance

Regarding the surface of a resulting decorative part, the color tone in a L*a*b* color specification system was measured by a color meter (CM2600d) manufactured by Konica Minolta Holdings, Inc.

Next, using an abrasion-testing machine [Trade name: NUS-ISO-2] manufactured by Suga Test Instruments Co., Ltd., flaws were made by the following method. As an abrasive paper for adhering an abrasion ring, a lapping film (#1200 having alumina particles of a diameter of 12 μm on the film surface) was used, the load of contacting the abrasive paper and a specimen was 100 g and the number of reciprocating motion was 50 times.

The color tone of the surface which was flawed was measured by the above color meter and the color difference ΔE*a*b* between before and after the surface was flawed was measured. The resulting ΔE*a*b* was evaluated in the following criterions. ◎ or ○ was decided to be acceptable, and X was decided to be unacceptable.

◎: ΔE*a*b*<2(Flaws were scarcely observed.)

○: 2≤ΔE*a*b*<5 (Flaws were hardly observed and a base layer was not observed.)

X: ΔE*a*b*≥5 (Flaws were observed and a part or most of a base layer was observed.)

(5) Corrosion Resistance

The corrosion resistance of a resulting decorative part was evaluated by spraying brine mixed with acetic acid and a small amount of copper (II) chloride and observing the surface whether it was discolored (X) or not discolored (○) based on the plating corrosion resistance testing method described in JIS H8502 (CASS test).

(6) Adhesion

A commercial adhesive tape was stuck on the definite area (2.3 cm×5.0 cm) of the surface of a resulting decorative part and the tape was peeled off. The adhesion was evaluated by observing the condition of the adhesive surface of the adhesive tape in the following criterions.

○: There was no adhesion of a coating film derived from the surface of a decorative part.

X: There was adhesion of a coating film derived from the surface of a decorative part.

(7) Overall Evaluation

In the evaluations (1) to (7), a decorative part having the result that all of the evaluations were acceptable was decided to be acceptable (○), and a decorative part having the result that at least one of the evaluations was unacceptable was decided to be unacceptable (X).

In the following examples and comparative examples according to the present invention, all of the evaluations (1) to (7) were carried out.

Examples 1 to 11 are shown in Table 1 together with Comparative Example 1. The overall evaluations in Examples 1 to 11 were acceptable, but the flaw resistance was unacceptable and the overall evaluation was also unacceptable in Comparative Example 1. That is to say, when a decorative part has no primary layer, the flaw resistance is unacceptable. In the primary layer, the repetition number n of lamination is preferably 1 to 11, more preferably 4 to 10.

TABLE 1

| | Ex. 1 | Ex. 2 | Ex. 3 | Ex. 4 | Ex. 5 | Ex. 6 |
|---|---|---|---|---|---|---|
| Film thickness of Finishing layer (μm) | 0.02 | 0.02 | 0.02 | 0.02 | 0.02 | 0.02 |
| Each film thickness of Primary layer (μm) | 0.005 | 0.005 | 0.005 | 0.005 | 0.005 | 0.005 |
| Repetition number n of lamination | 1 | 2 | 3 | 4 | 5 | 6 |
| Lightness (L*) | 81.5 | 81.80 | 81.40 | 81.60 | 81.50 | 82.00 |
| Color difference ΔE*a*b* | 2.31 | 2.24 | 2.18 | 2.14 | 2.26 | 2.29 |
| Hardness (Hv) | 1820 | 1810 | 1790 | 1770 | 1780 | 1790 |
| Flaw resistance | ○ | ○ | ○ | ◎ | ◎ | ◎ |
| Corrosion resistance | ○ | ○ | ○ | ○ | ○ | ○ |
| Adhesion | ○ | ○ | ○ | ○ | ○ | ○ |
| Overall evaluation | ○ | ○ | ○ | ○ | ○ | ○ |

| | Ex. 7 | Ex. 8 | Ex. 9 | Ex. 10 | Ex. 11 | Compar. Ex. 1 |
|---|---|---|---|---|---|---|
| Film thickness of Finishing layer (μm) | 0.02 | 0.02 | 0.02 | 0.02 | 0.02 | 0.02 |
| Each film thickness of Primary layer (μm) | 0.005 | 0.005 | 0.005 | 0.005 | 0.005 | — |
| Repetition number n of lamination | 7 | 8 | 9 | 10 | 11 | — |

TABLE 1-continued

| | | | | | | |
|---|---|---|---|---|---|---|
| Lightness (L*) | 81.3 | 81.2 | 81.6 | 81.7 | 81.5 | 80.5 |
| Color difference ΔE*a*b* | 2.31 | 2.18 | 2.20 | 2.26 | 2.21 | 3.81 |
| Hardness (Hv) | 1760 | 1770 | 1780 | 1720 | 1700 | 1790 |
| Flaw resistance | ◎ | ◎ | ◎ | ◎ | ○ | X |
| Corrosion resistance | ○ | ○ | ○ | ○ | ○ | ○ |
| Adhesion | ○ | ○ | ○ | ○ | ○ | ○ |
| Overall evaluation | ○ | ○ | ○ | ○ | ○ | X |

Examples 12-17

In each example, a stainless steel 316L material was mechanically processed to a watchcase, the surface thereof was mirror polished and degreased and washed by an organic solvent etc. to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.01 μm of a Au—Cu—Pd alloy film in Ar plasma from an alloy target having an Au-8Cu-1Pd composition and 0.01 μm of a Ti carbonitride layer in Ar, nitrogen and methane mixed plasma were formed one after the other repeatedly to form the primary layer 2. The repetition number n was 1 to 6 times. Subsequently, on each of these specimens, an Au—Cu—Pd alloy film was formed from an alloy target having a Au-8Cu-1Pd composition in Ar plasma to form the finishing layer 1 having a thickness of 0.02 μm and thereby a decorative part was prepared.

The composition of the Au—Cu—Pd alloy film was Au-(8.5±0.2)Cu-(1.0±0.1)Pd (% by mass).

The decorative parts prepared in Examples 12 to 17 were evaluated regarding (1) brightness, (2) color difference, (3) hardness, (4) flaw resistance, (5) corrosion resistance, (6) adhesion and (7) overall evaluation. The results are shown in Table 2 together with Comparative Example 1. The overall evaluations in Examples 12 to 17 were acceptable, but the flaw resistance was unacceptable and the overall evaluation was also unacceptable in Comparative Example 1. That is to say, when a decorative part has no primary layer, the flaw resistance is unacceptable. In the primary layer, the repetition number n of lamination is preferably 1 to 6, more preferably 2 to 5.

TABLE 2

| | Ex. 12 | Ex. 13 | Ex. 14 | Ex. 15 | Ex. 16 | Ex. 17 | Compar. Ex. 1 |
|---|---|---|---|---|---|---|---|
| Film thickness of Finishing layer (μm) | 0.02 | 0.02 | 0.02 | 0.02 | 0.02 | 0.02 | 0.02 |
| Each film thickness of Primary layer (μm) | 0.01 | 0.01 | 0.01 | 0.01 | 0.01 | 0.01 | — |
| Repetition number n of lamination | 1 | 2 | 3 | 4 | 5 | 6 | — |
| Lightness (L*) | 81.7 | 81.6 | 82.1 | 82 | 81.9 | 81.4 | 80.5 |
| Color difference ΔE*a*b* | 2.55 | 2.16 | 2.18 | 2.20 | 2.15 | 2.19 | 3.81 |
| Hardness (Hv) | 1810 | 1780 | 1780 | 1750 | 1700 | 1650 | 1790 |
| Flaw resistance | ○ | ◎ | ◎ | ◎ | ◎ | ○ | X |
| Corrosion resistance | ○ | ○ | ○ | ○ | ○ | ○ | ○ |
| Adhesion | ○ | ○ | ○ | ○ | ○ | ○ | ○ |
| Overall evaluation | ○ | ○ | ○ | ○ | ○ | ○ | X |

Examples 18 to 21

In each example, a stainless steel 316L material was mechanically processed to a watchcase, the surface thereof was mirror polished and degreased and washed by an organic solvent etc. to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma.

In this way, the base layer 3 having a thickness of 1.0 μm was formed. Subsequently, 0.015 μm of a Au—Cu—Pd alloy film in Ar plasma from an alloy target having an Au-8Cu-1Pd composition and 0.015 μm of a Ti carbonitride film in Ar, nitrogen and methane mixed plasma were formed one after the other repeatedly to form the primary layer 2. The repetition number n was 1 to 4 times. Subsequently, on each of these specimens, an Au—Cu—Pd alloy film was formed from an alloy target having a Au-8Cu-1Pd composition in Ar plasma to form the finishing layer 1 having a thickness of 0.02 μm and thereby a decorative part was prepared.

The composition of the Au—Cu—Pd alloy film was Au-(8.5±0.2)Cu-(1.0±0.1)Pd (% by mass).

The decorative parts prepared in Examples 18 to 21 were evaluated regarding (1) brightness, (2) color difference, (3) hardness, (4) flaw resistance, (5) corrosion resistance, (6) adhesion and (7) overall evaluation. The results are shown in Table 3 together with Comparative Example 1. The overall evaluations in Examples 18 to 21 were acceptable, but the flaw resistance was unacceptable and the overall evaluation was also unacceptable in Comparative Example 1. That is to say, when a decorative part has no primary layer, the flaw resistance is unacceptable. In the primary layer, the repetition number n of lamination is preferably 1 to 4, more preferably 1.

TABLE 3

| | Ex. 18 | Ex. 19 | Ex. 20 | Ex. 21 | Compar. Ex. 1 |
|---|---|---|---|---|---|
| Film thickness of Finishing layer (μm) | 0.02 | 0.02 | 0.02 | 0.02 | 0.02 |
| Each film thickness of Primary layer (μm) | 0.015 | 0.015 | 0.015 | 0.015 | — |
| Repetition number n of lamination | 1 | 2 | 3 | 4 | — |
| Lightness (L*) | 81.5 | 81.3 | 82.0 | 81.8 | 80.5 |
| Color difference ΔE*a*b* | 2.30 | 2.21 | 2.18 | 2.29 | 3.81 |
| Hardness (Hv) | 1770 | 1780 | 1750 | 1700 | 1790 |
| Flaw resistance | ◎ | ○ | ○ | ○ | X |
| Corrosion resistance | ○ | ○ | ○ | ○ | ○ |
| Adhesion | ○ | ○ | ○ | ○ | ○ |
| Overall evaluation | ○ | ○ | ○ | ○ | X |

Examples 22 to 24

In each example, a stainless steel 316L material was mechanically processed to a watchcase, the surface thereof was mirror polished, and degreased and washed by an organic solvent etc. to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.02 μm of a Au—Cu—Pd alloy film in Ar plasma from an alloy target having an Au-8Cu-1Pd composition and 0.02 μm of a Ti carbonitride film in Ar, nitrogen and methane mixed plasma were formed one after the other repeatedly to form the primary layer 2. The repetition number n was 1 to 3 times. Subsequently, on each of these specimens, an Au—Cu—Pd alloy film was formed from an alloy target having a Au-8Cu-1Pd composition in Ar plasma to form the finishing layer 1 having a thickness of 0.02 μm and thereby a decorative part was prepared.

The composition of the Au—Cu—Pd alloy film was Au-(8.5±0.2)Cu-(1.0±0.1)Pd (% by mass).

The decorative parts prepared in Examples 22 to 24 were evaluated regarding (1) brightness, (2) color difference, (3) hardness, (4) flaw resistance, (5) corrosion resistance, (6) adhesion and (7) overall evaluation. The results are shown in Table 4 together with Comparative Example 1. The overall evaluations in Examples 22 to 24 were acceptable, but the flaw resistance was unacceptable and the overall evaluation was also unacceptable in Comparative Example 1. That is to say, when a decorative part has no primary layer, the flaw resistance is unacceptable. In the primary layer, the repetition number n of lamination is preferably 1 to 3, more preferably 1.

TABLE 4

| | Ex. 22 | Ex. 23 | Ex. 24 | Compar. Ex. 1 |
|---|---|---|---|---|
| Film thickness of Finishing layer (μm) | 0.02 | 0.02 | 0.02 | 0.02 |
| Each film thickness of Primary layer (μm) | 0.02 | 0.02 | 0.02 | — |
| Repetition number n of lamination | 1 | 2 | 3 | — |
| Lightness (L*) | 81.7 | 81.5 | 82.0 | 80.5 |
| Color difference ΔE*a*b* | 2.14 | 2.25 | 2.18 | 3.81 |
| Hardness (Hv) | 1750 | 1710 | 1670 | 1790 |
| Flaw resistance | ◎ | ○ | ○ | X |
| Corrosion resistance | ○ | ○ | ○ | ○ |
| Adhesion | ○ | ○ | ○ | ○ |
| Overall evaluation | ○ | ○ | ○ | X |

Examples 25 and 26

In each example, a stainless steel 316L material was mechanically processed to a watchcase, the surface thereof was mirror polished, and degreased and washed by an organic solvent etc. to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.03 μm of a Au—Cu—Pd alloy film in Ar plasma from an alloy target having an Au-8Cu-1Pd composition and 0.03 μm of a Ti carbonitride film in Ar, nitrogen and methane mixed plasma were formed one after the other repeatedly to form the primary layer 2. The repetition number n was 1 to 2. Subsequently, on each of these specimens, an Au—Cu—Pd alloy film was formed from an alloy target having a Au-8Cu-1Pd composition in Ar plasma to form the finishing layer 1 having a thickness of 0.02 μm and thereby a decorative part was prepared.

The composition of the Au—Cu—Pd alloy film was Au-(8.5±0.2)Cu-(1.0±0.1)Pd (% by mass).

Comparative Example 2

In Comparative Example 2, a base layer 3 and a finishing layer 3 were formed without formation of a primary layer 2. The base layer 3 was formed by first forming 0.2 μm of a Ti metal layer in Ar plasma and then forming 0.8 μm of a Ti carbonitride layer in Ar, nitrogen and methane mixed plasma. In the above way, 1.0 μm of the base layer was formed. Subsequently, an Au—Cu—Pd alloy film was formed from an alloy target having an Au-8Cu-1Pd composition in Ar plasma to form the finishing layer having a thickness of 0.01 μm. Thus, a decorative part was prepared.

The decorative parts prepared in Examples 25 and 26 were evaluated regarding (1) brightness, (2) color difference, (3) hardness, (4) flaw resistance, (5) corrosion resistance, (6) adhesion and (7) overall evaluation. The results are shown in Table 5 together with Comparative Example 2. The overall evaluations in Examples 25 and 26 were acceptable, but the flaw resistance was unacceptable and the overall evaluation was also unacceptable in Comparative Example 2. That is to say, when a decorative part at least has no primary layer, the flaw resistance is unacceptable. In the primary layer, the repetition number n of lamination is preferably 1 to 2.

TABLE 5

| | Ex. 25 | Ex. 26 | Compar. Ex. 2 |
|---|---|---|---|
| Film thickness of Finishing layer (μm) | 0.02 | 0.02 | 0.01 |
| Each film thickness of Primary layer (μm) | 0.03 | 0.03 | — |
| Repetition number n of lamination | 1 | 2 | — |
| Lightness (L*) | 81.5 | 82 | 81.1 |
| Color difference ΔE*a*b* | 2.21 | 2.18 | 2.39 |
| Hardness (Hv) | 1750 | 1690 | 1810 |
| Flaw resistance | ○ | ○ | X |
| Corrosion resistance | ○ | ○ | ○ |
| Adhesion | ○ | ○ | ○ |
| Overall evaluation | ○ | ○ | X |

Examples 27 to 34

In each example, a stainless steel 316L material was mechanically processed to a watchcase, the surface thereof was mirror polished, to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.01 μm of a Au—Cu—Pd alloy film in Ar plasma from an alloy target having an Au-8Cu-1Pd composition and 0.01 μm of a Ti carbonitride film in Ar, nitrogen and methane mixed plasma were formed one after the other repeatedly to form the primary layer 2. The repetition number n was 4. Subsequently, on each of these specimens, an Au—Cu—Pd alloy film was formed from an alloy target having a Au-8Cu-1Pd composition in Ar plasma to form the finishing layer 1 having a thickness of 0.005 to 0.08 μm and thereby a decorative part was prepared.

The composition of the Au—Cu—Pd alloy film was Au-(8.5±0.2)Cu-(1.0±0.1)Pd (% by mass).

The decorative parts prepared in Examples 27 to 34 were evaluated regarding (1) brightness, (2) color difference, (3) hardness, (4) flaw resistance, (5) corrosion resistance, (6) adhesion and (7) overall evaluation. The results are shown in Table 6 together with Comparative Example 2. The overall evaluations in Examples 27 to 34 were acceptable, but the flaw resistance was unacceptable and the overall evaluation was also unacceptable in Comparative Example 2. That is to say, when a decorative part at least has no primary layer 2, the flaw resistance is unacceptable. The finishing layer 2 has a thickness of preferably 0.005 to 0.08 μm, more preferably 0.01 to 0.05 μm.

TABLE 6

| | Ex. 27 | Ex. 28 | Ex. 29 | Ex. 30 | Ex. 31 |
|---|---|---|---|---|---|
| Film thickness of Finishing layer (μm) | 0.005 | 0.01 | 0.03 | 0.04 | 0.05 |
| Each film thickness of Primary layer (μm) | 0.01 | 0.01 | 0.01 | 0.01 | 0.01 |
| Repetition number n of lamination | 4 | 4 | 4 | 4 | 4 |
| Lightness (L*) | 80.1 | 81.5 | 82.4 | 82.6 | 82.8 |
| Color difference ΔE*a*b* | 5.32 | 2.51 | 2.18 | 2.14 | 1.99 |
| Hardness (Hv) | 1780 | 1780 | 1770 | 1780 | 1790 |
| Flaw resistance | ○ | ◎ | ◎ | ◎ | ◎ |
| Corrosion resistance | ○ | ○ | ○ | ○ | ○ |
| Adhesion | ○ | ○ | ○ | ○ | ○ |
| Overall evaluation | ○ | ○ | ○ | ○ | ○ |

| | Ex. 32 | Ex. 33 | Ex. 34 | Compar. Ex. 2 |
|---|---|---|---|---|
| Film thickness of Finishing layer (μm) | 0.06 | 0.07 | 0.08 | 0.01 |
| Each film thickness of Primary layer (μm) | 0.01 | 0.01 | 0.01 | — |
| Repetition number n of lamination | 4 | 4 | 4 | — |
| Lightness (L*) | 83.1 | 83.6 | 83.9 | 81.1 |
| Color difference ΔE*a*b* | 1.85 | 1.26 | 0.85 | 2.39 |
| Hardness (Hv) | 1760 | 1750 | 1740 | 1810 |
| Flaw resistance | ○ | ○ | ○ | X |
| Corrosion resistance | ○ | ○ | ○ | ○ |
| Adhesion | ○ | ○ | ○ | ○ |
| Overall evaluation | ○ | ○ | ○ | X |

<Example concerning Embodiment 2>

In each example, a stainless steel SUS316L material was mechanically processed to prepare a watchcase, the surface thereof was mirror polished, and degreased and cleaned with an organic solvent etc, to prepare a substrate. On the substrate, the above base layer, primary layer and finishing layer were continuously formed by a sputtering method and then heat-treated to deposit an ordered lattice in the Au alloy, and thereby a sophisticated pink Au alloy color decorative part having improved flaw resistance was prepared by deposition hardening.

Examples 35-38

In each example, a stainless steel 316L material was mechanically processed to a watchcase, the surface thereof was mirror polished, to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.005 μm of a Au—Cu—Pd alloy film in Ar plasma from an alloy target having an Au-8Cu-1Pd composition and 0.005 μm of a Ti carbonitride film in Ar, nitrogen and methane mixed plasma were formed one after the other repeatedly to form the primary layer 2. The repetition number n was 1 and 11 to 13. Subsequently, on each of these specimens, an Au—Cu—Pd alloy film was formed from an alloy target having a Au-8Cu-1Pd composition in Ar plasma to form the finishing layer having a thickness of 0.02 μm. Next, the specimen was placed in a vacuum heat-treating oven (under $5\times10^{-4}$ Pa) and heat-treated at 350° C. for 1 hr to prepare a decorative part.

The composition of the Au—Cu—Pd alloy film was Au-(8.5±0.2)Cu-(1.0±0.1)Pd (% by mass).

The decorative parts prepared in Examples 35 to 38 were evaluated regarding (1) brightness, (2) color difference, (3) hardness, (4) flaw resistance, (5) corrosion resistance, (6) adhesion and (7) overall evaluation. The results are shown in Table 7. The overall evaluations in Examples 35 to 38 were acceptable. The decorative part of Example 35 was prepared by heat-treating a decorative part having the same film composition of Example 1. The decorative part of Example 35 had enhanced flaw resistance and brightness (L*) as compared with one of Example 1. Furthermore, the decorative part of Example 36 had also enhanced flaw resistance and lightness (L*) as compared with one of Example 11. That is to say, by adding heat-treatment, the hardness was increased and thereby the flaw resistance was improved. Before and after the heat-treatment, the surface of the resulting decorative part was measured by XRD, and the results are shown in FIG. 2. The result before the heat-treatment is the XRD profile of the decorative part in Example 1, and the result after the heat-treatment is the XRD profile of the decorative part in Example 35. After the heat-treatment, an ordered lattice was deposited (Peaks derived from $Au_3Cu$ type and AuCu type appeared. That is to say, peaks derived from AuCu appeared at 2θ=(23.9)° and 2θ=(31.9)° and peaks derived from $Au_3Cu$ appeared at 2θ=(22.3)° and 2θ=(31.7)°). It shows that since the hardness was increased together with deposition hardening, the flaw resistance was improved. The decorative part of Example 11 showed the same XRD measurement results as the decorative part of Example 1. The decorative parts of Examples 36 to 38 showed the same XRD measurement results as the decorative part of Example 35. Furthermore, the brightness (L*) was increased because after the heat-treatment, the Au—Cu—Pd alloy film of the finishing layer 1 was re-crystallized and thereby the surface was smoothened. The decorative part had more sophisticated appearance.

TABLE 7

| | Ex. 35 | Ex. 36 | Ex. 37 | Ex. 38 |
|---|---|---|---|---|
| Film thickness of Finishing layer (μm) | 0.02 | 0.02 | 0.02 | 0.02 |
| Each film thickness of Primary layer (μm) | 0.005 | 0.005 | 0.005 | 0.005 |
| Repetition number n of lamination | 1 | 11 | 12 | 13 |
| Heat treatment | conducted | conducted | conducted | conducted |
| Lightness (L*) | 82.3 | 82.5 | 82.4 | 82 |
| Color difference ΔE*a*b* | 2.04 | 2.01 | 2.04 | 2.08 |
| Hardness (Hv) | 1850 | 1750 | 1730 | 1710 |
| Flaw resistance | ◎ | ◎ | ◎ | ○ |
| Corrosion resistance | ○ | ○ | ○ | ○ |
| Adhesion | ○ | ○ | ○ | ○ |
| Overall evaluation | ○ | ○ | ○ | ○ |

Examples 39-41

In each example, a stainless steel 316L material was mechanically processed to a watchcase and the surface thereof was mirror polished to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.01 μm of a Au—Cu—Pd alloy film in Ar plasma from an alloy target having an Au-8Cu-1Pd composition and 0.01 μm of a Ti carbonitride layer in Ar, nitrogen and methane mixed plasma were formed one after the other repeatedly to form the primary layer 2. The repetition number n was 6 to 8. Subsequently, on each of these specimens, an Au—Cu—Pd alloy film was formed from an alloy target having a Au-8Cu-1Pd composition in Ar plasma to form the finishing layer having a thickness of 0.02 p.m. Next, the specimen was placed in a vacuum heat-treating oven (under $5\times10^{-4}$ Pa) and heat-treated at 350° C. for 1 hr to prepare a decorative part.

The composition of the Au—Cu—Pd alloy film was Au-(8.5±0.2)Cu-(1.0±0.1)Pd (% by mass).

The decorative parts prepared in Examples 39 to 41 were evaluated regarding (1) brightness, (2) color difference, (3) hardness, (4) flaw resistance, (5) corrosion resistance, (6) adhesion and (7) overall evaluation. The results are shown in Table 8. The overall evaluations in Examples 39 to 41 were acceptable. The decorative part of Example 39 was prepared by heat-treating a decorative part having the same film composition of Example 17. The decorative part of Example 39 had enhanced flaw resistance and brightness (L*) as compared with one of Example 17. That is to say, by adding heat-treatment, the hardness was increased and thereby the flaw resistance was enhanced. The decorative part of Example 17 showed the same XRD measurement results as one of Example 1, and the decorative parts of Examples 39 to 41 showed the same XRD measurement results as one of Example 35. Specifically, after the heat-treatment, an ordered lattice was deposited (Peaks derived from $Au_3Cu$ type and AuCu type appeared. That is to say, peaks derived from AuCu appeared at 2θ=(23.9)° and 2θ=(31.9)° and peaks derived from $Au_3Cu$ appeared at 2θ=(22.3)° and 2θ=(31.7)°). It shows that since the hardness was increased together with deposition hardening, the flaw resistance was enhanced. Furthermore, the brightness (L*) was increased because after the heat-treatment, the Au—Cu—Pd alloy film of the finishing layer 1 was re-crystallized and thereby the surface was smoothened. The decorative part had more sophisticated appearance.

TABLE 8

| | Ex. 39 | Ex. 40 | Ex. 41 |
|---|---|---|---|
| Film thickness of Finishing layer (μm) | 0.02 | 0.02 | 0.02 |
| Each film thickness of Primary layer (μm) | 0.01 | 0.01 | 0.01 |
| Repetition number n of lamination | 6 | 7 | 9 |
| Heat treatment | conducted | conducted | conducted |
| Lightness (L*) | 82.1 | 81.8 | 81.5 |
| Color difference ΔE*a*b* | 2.07 | 2.15 | 2.11 |
| Hardness (Hv) | 1700 | 1710 | 1700 |
| Flaw resistance | ◎ | ◎ | ○ |
| Corrosion resistance | ○ | ○ | ○ |
| Adhesion | ○ | ○ | ○ |
| Overall evaluation | ○ | ○ | ○ |

Examples 42 to 44

In each example, a stainless steel 316L material was mechanically processed to prepare a watchcase and the surface thereof was mirror polished to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.015 μm of a Au—Cu—Pd alloy film in Ar plasma from an alloy target having an Au-8Cu-1Pd composition and 0.015 μm of a Ti carbonitride film in Ar, nitrogen and methane mixed plasma were formed one after the other repeatedly to form the primary layer 2. The repetition number n was 4 to 6. Subsequently, on each of these specimens, an Au—Cu—Pd alloy film was formed from an alloy target having a Au-8Cu-1Pd composition in Ar plasma to form the finishing layer having a thickness of 0.02 p.m. Next, the specimen was placed in a vacuum heat-treating oven (under $5\times10^{-4}$ Pa) and heat-treated at 350° C. for 1 hr to prepare a decorative part.

The composition of the Au—Cu—Pd alloy film was Au-(8.5±0.2)Cu-(1.0±0.1)Pd (% by mass).

The decorative parts prepared in Examples 42 to 44 were evaluated regarding (1) brightness, (2) color difference, (3) hardness, (4) flaw resistance, (5) corrosion resistance, (6) adhesion and (7) overall evaluation. The results are shown in Table 9. The overall evaluations in Examples 42 to 44 were acceptable. The decorative part of Example 42 was prepared by heat-treating a decorative part having the same film composition of Example 21. The decorative part of Example 42 had enhanced flaw resistance and brightness (L*) as compared with one of Example 21. That is to say, by adding heat-treatment, the hardness was increased and thereby the flaw resistance was enhanced. The decorative part of Example 21 showed the same XRD measurement results as one of Example 1, and the decorative parts of Examples 42 to 44 showed the same XRD measurement results as one of Example 35. Specifically, after the heat-treatment, an ordered lattice was deposited (Peaks derived from $Au_3Cu$ type and AuCu type appeared. That is to say, peaks derived from AuCu appeared at 2θ=(23.9)° and 2θ=(31.9)° and peaks derived from $Au_3Cu$ appeared at 2θ=(22.3)° and 2θ=(31.7)°). It shows that since the hardness was increased together with deposition hardening, the flaw resistance was enhanced. Furthermore, the brightness (L*) was increased because after the heat-treatment, the Au—Cu—Pd alloy film of the finishing layer 1 was re-crystallized and thereby the surface was smoothened. The decorative part had more sophisticated appearance.

TABLE 9

| | Ex. 42 | Ex. 43 | Ex. 44 |
|---|---|---|---|
| Film thickness of Finishing layer (μm) | 0.02 | 0.02 | 0.02 |
| Each film thickness of Primary layer (μm) | 0.015 | 0.015 | 0.015 |
| Repetition number n of lamination | 4 | 5 | 6 |
| Heat treatment | conducted | conducted | conducted |
| Lightness (L*) | 82.8 | 82.5 | 82.1 |
| Color difference ΔE*a*b* | 2.01 | 2.05 | 2.01 |
| Hardness (Hv) | 1720 | 1730 | 1710 |
| Flaw resistance | ◎ | ◎ | ○ |
| Corrosion resistance | ○ | ○ | ○ |
| Adhesion | ○ | ○ | ○ |
| Overall evaluation | ○ | ○ | ○ |

Examples 45 to 47

In each example, a stainless steel 316L material was mechanically processed to prepare a watchcase and the surface thereof was mirror polished to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.02 μm of a Au—Cu—Pd alloy film in Ar plasma from an alloy target having an Au-8Cu-1Pd composition and 0.02 μm of a Ti carbonitride film in Ar, nitrogen and methane mixed plasma were formed one after the other repeatedly to form the primary layer 2. The repetition number n was 3 to 5. Subsequently, on each of these specimens, an Au—Cu—Pd alloy film was formed from an alloy target having a Au-8Cu-1Pd composition in Ar plasma to form the finishing layer having a thickness of 0.02 p.m. Next, the specimen was placed in a vacuum heat-treating oven (under $5\times10^{-4}$ Pa) and heat-treated at 350° C. for 1 hr to prepare a decorative part.

The composition of the Au—Cu—Pd alloy film was Au-(8.5±0.2)Cu-(1.0±0.1)Pd (% by mass).

The decorative parts prepared in Examples 45 to 47 were evaluated regarding (1) brightness, (2) color difference, (3) hardness, (4) flaw resistance, (5) corrosion resistance, (6) adhesion and (7) overall evaluation. The results are shown in Table 10. The overall evaluations in Examples 45 to 47 were acceptable. The decorative part of Example 45 was prepared by heat-treating a decorative part having the same film composition of Example 24. The decorative part of Example 45 had enhanced flaw resistance and brightness (L*) as compared with one of Example 24. That is to say, by adding heat-treatment, the hardness was increased and thereby the flaw resistance was enhanced. The decorative part of Example 24 showed the same XRD measurement results as one of Example 1, and the decorative parts of Examples 45 to 47 showed the same XRD measurement results as one of Example 35. Specifically, after the heat-treatment, an ordered lattice was deposited (Peaks derived from $Au_3Cu$ type and AuCu type appeared. That is to say, peaks derived from AuCu appeared at 2θ=(23.9)° and 2θ=(31.9)° and peaks derived from $Au_3Cu$ appeared at 2θ=(22.3)° and 2θ=(31.7)°). It shows that since the hardness was increased together with deposition hardening, the flaw resistance was enhanced. Furthermore, the brightness (L*) was increased because after the heat-treatment, the Au—Cu—Pd alloy film of the finishing layer 1 was re-crystallized and thereby the surface was smoothened. The decorative part had more sophisticated appearance.

TABLE 10

| | Ex. 45 | Ex. 46 | Ex. 47 |
|---|---|---|---|
| Film thickness of Finishing layer (μm) | 0.02 | 0.02 | 0.02 |
| Each film thickness of Primary layer (μm) | 0.02 | 0.02 | 0.02 |
| Repetition number n of lamination | 3 | 4 | 5 |
| Heat treatment | conducted | conducted | conducted |
| Lightness (L*) | 82.7 | 82.9 | 82.3 |
| Color difference ΔE*a*b* | 2.10 | 2.01 | 2.00 |

TABLE 10-continued

| | Ex. 45 | Ex. 46 | Ex. 47 |
|---|---|---|---|
| Hardness (Hv) | 1710 | 1720 | 1710 |
| Flaw resistance | ◎ | ◎ | ○ |
| Corrosion resistance | ○ | ○ | ○ |
| Adhesion | ○ | ○ | ○ |
| Overall evaluation | ○ | ○ | ○ |

Examples 48 to 50

In each example, a stainless steel 316L material was mechanically processed to prepare a watchcase and the surface thereof was mirror polished to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.03 μm of a Au—Cu—Pd alloy film in Ar plasma from an alloy target having an Au-8Cu-1Pd composition and 0.03 μm of a Ti carbonitride film in Ar, nitrogen and methane mixed plasma were formed one after the other repeatedly to form the primary layer 2. The repetition number n was 2 to 4. Subsequently, on each of these specimens, an Au—Cu—Pd alloy film was formed from an alloy target having a Au-8Cu-1Pd composition in Ar plasma to form the finishing layer having a thickness of 0.02 p.m. Next, the specimen was placed in a vacuum heat-treating oven (under $5\times10^{-4}$ Pa) and heat-treated at 350° C. for 1 hr to prepare a decorative part.

The composition of the Au—Cu—Pd alloy film was Au-(8.5±0.2)Cu-(1.0±0.1)Pd (% by mass).

The decorative parts prepared in Examples 48 to 50 were evaluated regarding (1) brightness, (2) color difference, (3) hardness, (4) flaw resistance, (5) corrosion resistance, (6) adhesion and (7) overall evaluation. The results are shown in Table 11. The overall evaluations in Examples 48 to 50 were acceptable. The decorative part of Example 48 was prepared by heat-treating a decorative part having the same composition of Example 26. The decorative part of Example 48 had enhanced flaw resistance and brightness (L*) as compared with one of Example 26. That is to say, by adding heat-treatment, the hardness was increased and thereby the flaw resistance was enhanced. The decorative part of Example 26 showed the same XRD measurement results as one of Example 1, and the decorative parts of Examples 48 to 50 showed the same XRD measurement results as one of Example 35. Specifically, after the heat-treatment, an ordered lattice was deposited (Peaks derived from $Au_3Cu$ type and AuCu type appeared. That is to say, peaks derived from AuCu appeared at 2θ=(23.9)° and 2θ=(31.9)° and peaks derived from $Au_3Cu$ appeared at 2θ=(22.3)° and 2θ=(31.7)°). It shows that since the hardness was increased together with deposition hardening, the flaw resistance was enhanced. Furthermore, the brightness (L*) was increased because after the heat-treatment, the Au—Cu—Pd alloy film of the finishing layer 1 was re-crystallized and thereby the surface was smoothened. The decorative part had more sophisticated appearance.

TABLE 11

| | Ex. 48 | Ex. 49 | Ex. 50 |
|---|---|---|---|
| Film thickness of Finishing layer (μm) | 0.02 | 0.02 | 0.02 |
| Each film thickness of Primary layer (μm) | 0.03 | 0.03 | 0.03 |
| Repetition number n of lamination | 2 | 3 | 4 |
| Heat treatment | conducted | conducted | conducted |
| Lightness (L*) | 82.7 | 82.3 | 82.5 |
| Color difference ΔE*a*b* | 1.99 | 2.15 | 2.10 |
| Hardness (Hv) | 1740 | 1730 | 1720 |
| Flaw resistance | ◎ | ◎ | ○ |
| Corrosion resistance | ○ | ○ | ○ |
| Adhesion | ○ | ○ | ○ |
| Overall evaluation | ○ | ○ | ○ |

Examples 51 to 54

In each example, a stainless steel 316L material was mechanically processed to prepare a watchcase and the surface thereof was mirror polished to prepare a substrate 4. On the substrate 4, a base layer 3, a primary layer 2 and a finishing layer 1 were formed by the DC sputtering method. The base layer 3 was formed by first forming 0.2 μm of a Ti metal layer in Ar plasma and then forming 0.8 μm of a Ti carbonitride layer in Ar, nitrogen and methane mixed plasma. In this way, the base layer 3 having a thickness of 1.0 μm was formed. Subsequently, 0.01 μm of a Au—Cu—Pd alloy film in Ar plasma from an alloy target having an Au-8Cu-1Pd composition and 0.01 μm of a Ti carbonitride film in Ar, nitrogen and methane mixed plasma were formed one after the other repeatedly to form the primary layer 2. The repetition number n was 4. Subsequently, on each of these specimens, an Au—Cu—Pd alloy film was formed from an alloy target having a Au-8Cu-1Pd composition in Ar plasma to form the finishing layer having a thickness of 0.005 μm, 0.08 μm, 0.09 μm or 0.10 p.m. Next, the specimen was placed in a vacuum heat-treating oven (under $5\times10^{-4}$ Pa) and heat-treated at 350° C. for 1 hr to prepare a decorative part.

The composition of the Au—Cu—Pd alloy film was Au-(8.5±0.2)Cu-(1.0±0.1)Pd (% by mass).

The decorative parts prepared in Examples 51 to 54 were evaluated regarding (1) brightness, (2) color difference, (3) hardness, (4) flaw resistance, (5) corrosion resistance, (6) adhesion and (7) overall evaluation. The results are shown in Table 12. The overall evaluations in Examples 51 to 54 were acceptable. The decorative part of Example 51 was prepared by heat-treating a decorative part having the same film composition of Example 27. The decorative part of Example 51 had enhanced flaw resistance and brightness (L*) as compared with one of Example 27. Furthermore, the decorative part of Example 52 similarly had enhanced flaw resistance and brightness (L*) as compared with one of Example 34. That is to say, by adding heat-treatment, the hardness was increased and thereby the flaw resistance was enhanced. The decorative parts of Examples 27 and 34 showed the same XRD measurement results as one of Example 1, and the decorative parts of Examples 51 to 54 showed the same XRD measurement results as one of Example 35. Specifically, after the heat-treatment, an ordered lattice was deposited (Peaks derived from $Au_3Cu$ type and AuCu type appeared. That is to say, peaks derived from AuCu appeared at 2θ=(23.9)° and 2θ=(31.9) and peaks derived from $Au_3Cu$ appeared at 2θ=(22.3)° and 2θ=(31.7)°). It shows that since the hardness was increased together with deposition hardening, the flaw resistance was enhanced. Furthermore, the lightness (L*) was increased because after the heat-treatment, the Au—Cu—Pd alloy film of the finishing layer 1 was re-crystallized and thereby the surface was smoothened. The decorative part had more sophisticated appearance.

TABLE 12

| | Ex. 51 | Ex. 52 | Ex. 53 | Ex. 54 |
|---|---|---|---|---|
| Film thickness of Finishing layer (μm) | 0.005 | 0.08 | 0.09 | 0.10 |
| Each film thickness of Primary layer (μm) | 0.01 | 0.01 | 0.01 | 0.01 |
| Repetition number n of lamination | 4 | 4 | 4 | 4 |
| Heat treatment | conducted | conducted | conducted | conducted |
| Lightness (L*) | 80.6 | 84.6 | 85.1 | 85.3 |
| Color difference ΔE*a*b* | 4.05 | 0.70 | 0.35 | 0.32 |
| Hardness (Hv) | 1820 | 1760 | 1730 | 1730 |
| Flaw resistance | ◎ | ◎ | ◎ | ○ |
| Corrosion resistance | ○ | ○ | ○ | ○ |
| Adhesion | ○ | ○ | ○ | ○ |
| Overall evaluation | ○ | ○ | ○ | ○ |

[Physical Properties of Base Layer and Primary Layer]

In the base layer of the above example, the Ti carbonitride had a Ti content of 76% by mass, a N content of 18% by mass and a C content of 6% by mass. In the primary layer, the Ti carbonitride had the same contents. These contents were determined by quantitatively analyzing the substrate formed with the base layer or the substrate formed with the base layer and the primary layer using XP (QUANTUM 2000) manufactured by PHYSICAL ELECTRONICS Co., Ltd.

In the above example, when the substrate formed with the base layer was measured, L* was 64.2, ΔE*a*b* was 20.1 and the surface hardness was 2200 (Hv).

In Example 2, when the substrate formed with the base layer and the primary layer was measured, L* was 74.0, ΔE*a*b* was 10.4 and the surface hardness was 1900 (Hv).

In Example 23, when the substrate formed with the base layer and primary layer was measured, L* was 74.8, ΔE*a*b* was 9.8 and the surface hardness was 1830 (Hv).

[Surface Roughness]

The surface roughness was determined by AFM measurement concerning the decorative parts prepared in Example 1 and Example 35.

Figure 3:
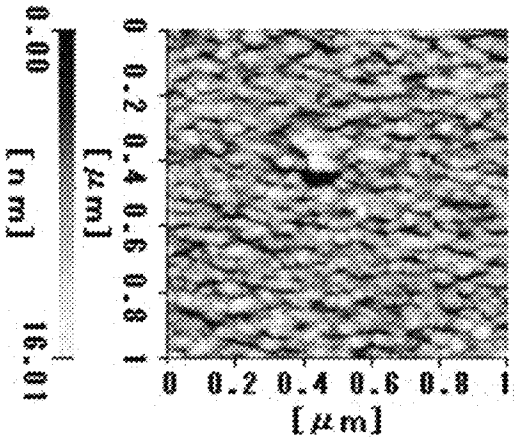
FIG. 3 shows a view showing the result of AFM measurement of a decorative part in one embodiment according to the present invention.
Figure 4:
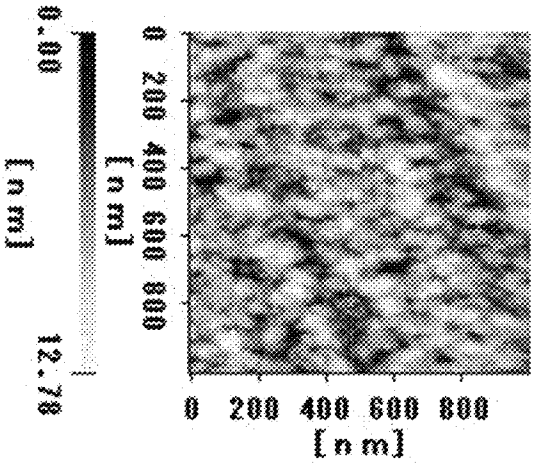
FIG. 4 shows a view showing the result of AFM measurement of a decorative part in one embodiment according to the present invention.

The results of the AFM measurement concerning the decorative part of Example 1 are shown in FIG. 3. The surface roughness of the decorative part of Example 1 was 1.819 nm. The results of the AFM measurement concerning the decorative part of Example 35 are shown in FIG. 4. The surface roughness of the decorative part of Example 35 was 1.615 nm. In the decorative part in which an ordered lattice was generated by the heat-treatment, the surface roughness was decreased.

The decorative parts prepared in Examples 17 and 39, Examples 21 and 42, Examples 24 and 45, Examples 26 and 48, Examples 27 and 51, and Examples 34 and 52 were compared on the surface roughness. The same results were obtained. That is to say, in the decorative part in which an ordered lattice was generated by the heat-treatment, the surface roughness was decreased.

Hereinbefore, the stainless steel was used as the substrate 4 in the examples. Moreover, even when Ti, a Ti alloy, Au, an Au alloy, Pt, a Pt alloy, Cu, a Cu alloy or ceramics was used as the substrate 4, the same results were obtained.

The invention claimed is:

1. A decorative part comprising a substrate and a hardening layer superimposed on the substrate, wherein:

the hardening layer is obtained by laminating a base layer, a primary layer and a finishing layer in order on the substrate, the base layer comprises a metal layer comprising Ti and, superimposed thereon, a compound layer comprising Ti, nitrogen, and carbon, the primary layer has a laminating structure such that an Au alloy layer, and a compound layer comprising Ti, nitrogen, and carbon are laminated one after the other starting from the Au alloy layer, and the finishing layer comprises an Au alloy layer, wherein the Au alloy layer in the primary layer or the Au alloy layer in the finishing layer comprises an Au alloy comprising Au and Cu as main components and further comprising at least one metal selected from the group consisting of Pd, Pt, Ag and Ni wherein the Au content is 79.5 to 94.5% by mass, the Cu content is 5 to 20% by mass and the at least one metal content is 0.5 to 5% by mass provided that the total of Au, Cu and the at least one metal is 100% by mass based upon the total mass of the Au alloy layer, and has an ordered lattice.

2. The decorative part according to claim 1 wherein the primary layer has a laminating structure such that lamination of one laminating structure unit, which is composed of one Au alloy layer and one compound layer, is repeated 1 to 11 times.

3. The decorative part according to claim 1 wherein the primary layer has a thickness of 0.01 to 0.12 μm.

4. The decorative part according to claim 1 wherein the substrate comprises at least one metal selected from a stainless steel, Ti, a Ti alloy, Au, an Au alloy, Pt, a Pt alloy, Cu and a Cu alloy.

5. The decorative part according to claim 1 wherein the substrate comprises ceramics.

6. A process for producing a decorative part comprising a substrate and a hardening layer obtained by laminating a base layer, a primary layer and a finishing layer in order on the substrate, which process comprises:

a base layer-laminating step of laminating, on the substrate, the base layer which comprises a metal layer comprising Ti, and, superimposed on the metal layer, a compound layer comprising the same metal constituting the metal layer and nitrogen and carbon, a primary layer-laminating step of laminating, on the base layer, the primary layer having a laminating structure such that an Au alloy layer, and a compound layer comprising Ti, nitrogen, and carbon are laminated one after the other starting from the Au alloy layer, and a finishing layer-laminating step of laminating, on the primary layer, the finishing layer comprising an Au alloy layer, an ordered lattice generating step of heating the substrate on which the hardening layer is formed in an inert atmosphere or under reduced pressure at 300 to 400° C. for 1 to 3 hr and thereby making the Au alloy layer in the primary layer or the Au alloy layer in the finishing layer into an Au alloy layer containing an ordered lattice, wherein the Au alloy layer in the primary layer or the Au alloy layer in the finishing layer comprises an Au alloy comprising Au and Cu as main components and further comprising at least one metal selected from the group consisting of Pd, Pt, Ag and Ni wherein the Au content is 79.5 to 94.5% by mass, the Cu content is 5 to 20% by mass and the least one metal content is 0.5 to 5% by mass provided that the total of Au, Cu and the at least one metal is 100% by mass based upon the total mass of the Au alloy layer.

7. The process for producing a decorative part according to claim 6 wherein the primary layer has a laminating structure such that lamination of one laminating structure unit, which is composed of one Au alloy layer and one compound layer, is repeated 1 to 11 times.

8. The process for producing a decorative part according to claim 6 wherein the primary layer has a thickness of 0.01 to 0.12 μm.

9. The process for producing a decorative part according to claim 6 wherein the substrate comprises at least one metal selected from a stainless steel, Ti, a Ti alloy, Au, an Au alloy, Pt, a Pt alloy, Cu and a Cu alloy.

10. The process for producing a decorative part according to claim 6 wherein the substrate comprises ceramics.

11. The process for producing a decorative part according to claim 6 wherein the base layer, the primary layer and the finishing layer are laminated by a dry plating method selected from a sputtering method, an ion plating method and an arc type ion plating method.

* * * * *